United States Patent [19]

Sperry et al.

[11] 4,093,474

[45] June 6, 1978

[54] METHOD FOR PREPARING ALUMINUM ALLOYS POSSESSING IMPROVED RESISTANCE WELDABILITY

[75] Inventors: Philip R. Sperry, North Haven, Conn.; William C. Setzer, Creve Coeur, Mo.; Lloyd E. Damon, Wallingford, Conn.

[73] Assignee: Swiss Aluminium Ltd., Chippis, Switzerland

[21] Appl. No.: 765,982

[22] Filed: Feb. 7, 1977

Related U.S. Application Data

[62] Division of Ser. No. 703,781, Jul. 9, 1976, Pat. No. 4,043,840.

[51] Int. Cl.[2] ..... C22F 1/04

[52] U.S. Cl. ..... 148/2; 148/11.5 A

[58] Field of Search ..... 75/138, 146, 147, 148; 148/159, 11.5 A, 12.7 A, 32, 32.5, 2

[56] References Cited

U.S. PATENT DOCUMENTS

| | | | |
|---|---|---|---|
| 1,305,166 | 5/1919 | Reardon | 75/147 |
| 1,910,861 | 5/1933 | Keller et al. | 75/147 |
| 1,932,843 | 10/1933 | Dean et al. | 75/147 |
| 3,232,796 | 2/1966 | Anderson | 148/12.7 A |
| 3,366,476 | 1/1968 | Jaqaciak | 75/147 |
| 3,642,542 | 2/1972 | Sperry et al. | 75/147 |
| 3,935,007 | 1/1976 | Baba et al. | 148/12.7 A |
| 3,938,991 | 2/1976 | Sperry et al. | 75/147 |

OTHER PUBLICATIONS

Alloy Digest — Al-39, Jun. 1973, Engr. Alloy Digest Inc., Upper Montclair, N.J.

Alloy Digest, Al-64, Mar. 1958, "Aluminium 5154".

*Primary Examiner*—R. Dean

*Attorney, Agent, or Firm*—Robert H. Bachman

[57] ABSTRACT

Aluminum alloys exhibiting improved resistance weldability are prepared which comprise 2.0–6.0% magnesium, up to 0.40% iron, up to 0.40% silicon, and from 0.03–0.20% vanadium, balance essentially aluminum. The alloys of the present invention are particularly suited for automotive metal working applications.

7 Claims, No Drawings

METHOD FOR PREPARING ALUMINUM ALLOYS POSSESSING IMPROVED RESISTANCE WELDABILITY

This is a division of application Ser. No. 703,781, filed July 9, 1976, now U.S. Pat. No. 4,043,840.

BACKGROUND OF THE INVENTION

The present invention relates to the preparation of aluminum alloys useful in automotive metal working applications, and particularly relates to the provision of alloys possessing improved resistance weldability.

Certain aluminum alloys have long been useful in applications such as the aircraft industry where extended sheets of material are joined to prepare a vehicle structure or body by resistance spot welding. Particularly in the aircraft industry, the technique of resistance spot welding has been highly developed where costs of the required equipment and elaborate production controls can be justified.

Two physical properties of aluminum are important in the practice of resistance spot welding. The first of these properties is the electrical resistivity which is known to be low by comparison with well-known steels, and therefore requires high welding currents to generate enough heat to make the weld. The other property comprises contact resistance existing at the surface of the metal, which, if excessively high and variable, causes pick-up or sticking of the metal to the welding electrodes, as well as extreme variability in the size, shape and strength of the resulting weld.

With the recent concern over energy consumption, the automotive industry has reviewed the types of materials being employed in substantial amounts in the structure of motor vehicles to determine whether efficiencies in weight reduction can be achieved by the selection of alternate materials. As the result, aluminum sheet alloys, which have characteristically found use in the aircraft industry, as well as alloys with more moderate strength and greater formability, are being investigated because of their reduced weight, corrosion resistance, and other favorable properties. An important factor, however, in the consideration of aluminum is its amenability to the resistance welding techniques presently useful with the steels currently employed. Thus, the ease of resistance welding in terms of minimal control and lower current requirements comprises an important factor which renders it desirable to tailor aluminum alloys to exhibit improved resistance weldability. One of the observations that has been made is that an increase in the bulk resistivity of the metal appears necessary, as it reduces total current requirements and makes contact resistances less critical.

SUMMARY OF THE INVENTION

In accordance with this invention, aluminum alloys possessing improved resistance weldability are prepared which comprise 2.0–6.0% magnesium, up to 0.40% iron, up to 0.40% silicon, and from 0.03–0.20% vanadium, balance essentially aluminum.

The alloys of the present invention exhibit decreases in conductivity over comparable commercial alloys not containing vanadium in the above amounts, and are particularly suited for automotive metal applications. Further, the performance of vanadium in the above amounts contributes to desirable ductility and formability by its entry into solid solution in the alloy.

A further advantage of the present invention is that the alloys may be processed in accordance with standard mill practice including employment of the faster DC casting technique, and do not require rigorous conditions for favorable results.

Accordingly, it is a principal object of the present invention to provide aluminum base alloys suitable for automotive metal working applications which exhibit improved resistance weldability.

It is a further object of the present invention to provide aluminum base alloys as aforesaid which achieve improved resistivity with the retention of desirable ductility and formability.

It is yet a further object of the present invention to provide aluminum base alloys as aforesaid which may be prepared by processes employing DC casting.

Further objects and advantages will be apparent from a consideration of the ensuing description.

DETAILED DESCRIPTION

In accordance with the present invention, the foregoing objects and advantages are readily attained.

The aluminum base alloys of the present invention comprise, in weight percent, from 2.0–6.0% magnesium, up to 0.40% iron, up to 0.40% silicon, and from 0.03–0.20% vanadium, balance essentially aluminum. In a preferred embodiment, the alloys of the present invention may contain from 2.0–5.0% magnesium, from 0.05–0.40% iron, from 0.05–0.40% silicon, and from 0.03–0.20% vanadium.

The aluminum base alloys prepared in accordance with the present invention are those which are designated as the 5000 Series alloys by the Aluminum Association. In addition to the elements stated above, the alloys of the present invention may provide the following additives: copper up to 0.4%, and preferably from 0.05–0.2%, manganese up to 6.0%, and preferably from 0.1–0.5%, chromium up to 0.4%, and preferably from 0.1–0.4%, nickel up to 0.3%, zirconium up to 0.15%, and zinc and titanium each up to 0.3%, and preferably from 0.1–0.3%. As a general rule, additives and other impurity elements may be present in amounts of about 0.05% each and totaling 0.15%, not adversely affecting the properties of the alloy.

An noted above, it has been found in accordance with the present invention that the aluminum base alloys of the 5000 Series to which vanadium has been added in the above stated amounts possess improved resistance weldability by virtue of the increase of the resistivity of the alloy. This stems partly from the fact that vanadium confers a relatively strong incremental increase in resistivity (3.50 $\mu\Omega$- cm per weight percent) and is capable of remaining in saturated solid solution in the alloy. Further, it does not affect or alter the basic characteristics of the alloy such as melting range, corrosion resistance, finishing characteristics or the like.

The 5000 Series alloys possess characteristics favorable for use in autobody applications with derive from the elements comprising the primary alloying ingredients. Thus, magnesium is a major alloy ingredient which confers significant strengthening and a high rate of work hardening. Manganese is added to improve strength slightly without sacrificing ducitility. Two particular alloys of the 5000 Series which appear to possess great potential in automotive applications are designated by the Aluminum Association as Alloys 5052 and 5454 which broadly comprises from 2.0 to about 3.0% magnesium, up to about 0.45% of a total of iron and/or silicon, balance essentially aluminum. These alloys may further contain up to about 0.10% copper, up to about 0.6% manganese, up to about 0.35% chromium, up to 0.25% zinc, up to 0.15% zirconium, and up to about 0.20% titanium, as well as other impurities in amounts of up to 0.05%, the total not exceeding 0.15%, which would not materially affect the properties of the composition. As with other members of the 5000 Series, the above alloys exhibit improved resistivity as the result of the addition of vanadium in an amount ranging from 0.03 to 0.20%.

A further example of an alloy of the 5000 Series possessing recognized utility in auto body applications is Alloy 5182 which comprises from 4.0–5.0% magnesium, up to about 0.35% iron, up to about 0.20% silicon, up to about 0.15% copper, from 0.20–0.50% manganese, up to about 0.10% chromium, up to about 0.25% zinc, up to about 0.15% zirconium, and up to 0.10% titanium, balance aluminum. Alloy 5182 contains a fairly large percentage of magnesium which, as noted earlier, provides strengthening and improved work hardening. As with the above-noted alloys of the 5000 Series, Alloy 5182 may likewise be modified by the addition of vanadium to improve its resistivity.

The alloys of the present invention may be processed in accordance with conventional practices and techniques. Thus, the alloys may be cast by DC casting, hot worked, such as by hot rolling, at temperatures such as, for example, 850° F, and cold worked as, for example, by cold rolling to reductions of, for example, 50% or greater. Such processing may be conducted in a manner well-known to those skilled in the art, and need not be further discussed herein.

In addition to ease of processing, the alloys of this invention possess improved tensile properties, ductility and formability which are comparable to acceptable levels achieved by conventional alloys. Most importantly, conductivity measurements show that much or all of the vanadium present in the alloys is retained in solid solution in the final annealed condition, with the result that the vanadium containing alloys were found to possess reduced levels of conductivity, corresponding with increased resistivity, by comparison with alloys which contained no vanadium.

The present invention will be more readily apparent from a consideration of the following illustrative examples.

EXAMPLE I

In this example, two aluminum base alloys of the 5000 Series comprising Alloys 5052 and 5454 were prepared, together with comparative alloys containing vanadium. The alloys possessed the nominal compositions set forth in Table I, below, wherein Alloys 1 and 2 represent Alloy 5052, and Alloys 3 and 4 represent Alloy 5454 with respect to magnesium content.

TABLE I

| Alloy Number | COMPOSITION (WEIGHT %) Mg | Fe | Si | V | Al |
|---|---|---|---|---|---|
| 1 | 2.0 | .07 | .05 | — | Bal. |
| 2 | 2.0 | .07 | .05 | .20 | Bal. |
| 3 | 3.0 | .07 | .05 | — | Bal. |
| 4 | 3.0 | .07 | .05 | .20 | Bal. |

The above alloys were cast by the Durville method, after which they were homogenized by heating at a rate of 50° F per hour from a temperature of 600° to 1025° F. The alloys were held at this temperature for 12 hours and were then air cooled and scalped, after which they were heated for hot rolling at a rate of 50° F per hour to a temperature of 850° F, and held at that temperature for about 1 hour. The alloys were then hot rolled to a thickness of 0.200 inch with reheating between passes, and were then cold rolled to 0.050 inch. The alloys were then annealed by heating at 50° F per hour from 300° to 650° F and then remaining at that temperature for 2 hours. The alloys were then air cooled and tested for tensile properties and conductivity. The results are set forth in Table II, below.

TABLE II

Effect of Vanadium on Mechanical Properties and Conductivity

| Alloy No. | Longitudinal Tensile Properties YS (ksi) | UTS (ksi) | Elong. (%) | Electrical Conductivity % IACS |
|---|---|---|---|---|
| 1 | 8.7 | 22.9 | 21.8 | 45.7 |
| 2 | 9.65 | 24.0 | 23.0 | 39.9 |
| 3 | 11.1 | 28.6 | 20.8 | 40.4 |
| 4 | 13.0 | 29.3 | 21.0 | 37.6 |

From the above Table, it can be seen that the alloy samples containing vanadium had tensile properties which exceeded those of the identical alloys containing no vanadium. Thus, the alloys prepared in accordance with the present invention appear to substantially retain all of the characteristic properties exhibited by the same alloys to which vanadium was not added.

A comparison of the conductivities of the respective samples, as measured in percent IACS reveals that the samples prepared in accordance with the present invention exhibited conductivities which were reduced by an average of from 3 to 5% IACS. This reduction in conductivity is significant, as it indicates a corresponding increase in resistivity which is substantial. Thus, the alloys of the present invention would be capable of forming into wrought articles such as automotive body sheets with substantially the same facility as that of comparable alloys to which vanadium is not added, and would additionally possess improved tensile properties. Further, and most importantly, the alloys of the present invention would be capable of resistance welding with greater ease and reliability, as the aforenoted vanadium addition significant reduces conductivity whereby a corresponding increase in resistivity is achieved. As noted earlier, this improvement is believed to be the result of the unique ability of vanadium to enter and remain in saturated solid solution in the formed alloy whereby formability and tensile properties of the alloys are not diminished and conductivity is effectively reduced.

Unless otherwise specified, all percentages of elements recited herein are expressed in percent by weight.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for the preparation of wrought products which comprises:

A. providing an aluminum base alloy consisting essentially of from about 2.0 to about 6.0% magnesium, up to 0.40% iron, up to 0.40% silicon, and from about 0.03 to 0.20% vanadium, balance aluminum;

(B) casting said alloy;

(C) heating said alloy to a homogenizing temperature and thereafter homogenizing said alloy;

(D) hot and cold working said alloy;

(E) annealing said alloy whereby the vanadium is substantially retained in solid solution to provide a wrought produce exhibiting reduced electrical conductivity, increased electrical resistivity, improved resistance weldability plus good tensile properties, said wrought product being capable of plastic deformation; and (F) resistance welding said wrought product to provide a resistance welded article.

2. The method of claim 1 wherein said alloy comprises from about 2.0 to 5.0% magnesium, from about 0.05 to 0.40% iron, from about 0.05 to 0.40% silicon, and from about 0.3 to 0.20% vanadium.

3. The method of claim 1 where said alloy is cast by the DC casting method.

4. The method of claim 1 wherein said hot working is commenced at a temperature of about 850° F.

5. The method of claim 1 wherein said alloy is not and cold worked by rolling.

6. The method of claim 1 wherein the heating of Step C is conducted at a rate of 50° F per hour to a homogenizing temperature of about 1025° F, and said alloy is then held at said homogenizing temperature for about 12 hours.

7. The method of claim 1 wherein said alloy is annealed by heating at a rate of 50° F per hour from 300° to 650° F, and is then held at 650° F for about 2 hours.

* * * * *